United States Patent [19]

Van Woensel

[11] Patent Number: 4,647,131

[45] Date of Patent: Mar. 3, 1987

[54] CONNECTOR WITH CONDUCTOR RETENTION MEANS

[75] Inventor: Johannes Maria B. Van Woensel, GP Rosmalen, Netherlands

[73] Assignee: E. I. Du Pont de Nemours and Company, Wilmington, Del.

[21] Appl. No.: 816,846

[22] Filed: Jan. 7, 1986

[30] Foreign Application Priority Data

Jan. 22, 1985 [NL] Netherlands ..... 8500161

[51] Int. Cl.[4] ..... H01R 9/07

[52] U.S. Cl. ..... 339/74 R; 339/17 F; 339/75 MP; 339/103 R; 339/176 MF

[58] Field of Search ..... 339/17 F, 74 R, 75 MP, 339/176 MF:103 R, 103 M, 105

[56] References Cited

U.S. PATENT DOCUMENTS

| | | | |
|---|---|---|---|
| 2,590,886 | 4/1952 | Pedersen | 173/322 |
| 3,070,771 | 12/1962 | Piorunneck | 339/17 F |
| 3,090,028 | 5/1963 | Hall et al. | 339/17 F |
| 3,214,723 | 10/1965 | Dupre et al. | 339/99 |
| 3,355,099 | 11/1967 | Whippo et al. | 235/60 |
| 3,355,699 | 11/1967 | Oshva | 339/99 |
| 3,437,981 | 4/1969 | Keller | 339/103 R |
| 3,621,449 | 11/1971 | Bridle | 339/176 MF |
| 4,252,392 | 2/1981 | Whiteman, Jr. | 339/74 R |
| 4,253,719 | 3/1981 | McGinley | 339/75 MP |
| 4,323,725 | 4/1982 | Muller | 339/103 R |
| 4,334,728 | 6/1982 | Reynolds et al. | 339/176 MF |
| 4,477,137 | 10/1984 | Ayer | 339/17 F |

FOREIGN PATENT DOCUMENTS

| | | |
|---|---|---|
| 1324140 | 3/1963 | France . |
| 2469016 | 5/1981 | France . |

*Primary Examiner*—John McQuade

[57] ABSTRACT

A connector for contacting one or a plurality of parallel connectors and retaining the conductors at the contact position. The connector includes two parallel extending contacts between which the conductor is inserted and electrically contacted. The connector further includes rotatable retaining means which enables the conductor to be inserted between the contacts and which also secures the conductor in place after it is contacted.

6 Claims, 6 Drawing Figures

CONNECTOR WITH CONDUCTOR RETENTION MEANS

BACKGROUND OF THE INVENTION

The invention relates to a connector for one or more conductors, provided with a contact element having two contacts with contact surfaces facing each other, which are pressed against each other under spring force and between which an electrical conductor to be contacted can be clamped.

Such connectors are frequently used for making rapid and efficient simultaneous contact to and retaining, in particular, several parallel conductors in, for example, a flat cable or in a flexible foil. It must be possible for the connection to the conductors of the latter to take place both on the underside and the upperside, for which reason two parallel contacts are used, for example, in the form of a fork, the contact surfaces of which are biased against each other under spring force.

SUMMARY OF THE INVENTION

The connector according to the present invention is characterised by at least one retaining element for the electrical conductor situated opposite the insertion position for the electrical conductor between the contacts. The retaining element includes at least one projecting part and a counterelement situated opposite this projecting part, between which the electrical conductor can be retained by friction. The projecting part is capable of being swivelled or rotated around a spindle towards and away from the contacts and the opposite counterelement. The end of the conductor to be retained is first pushed through and between the contacts when the projecting part is swivelled away from its position opposite the counterelement. By swivelling the projecting part to its position opposite the counterelement, the conductor is retained between the projecting part and the counter element.

By using the connector according to the invention, a force-closed contact system is obtained in which the conductor is held in its position without forces being exerted on the contact element. At the same time, before the securing, the surface of the bare conductor is slid along the contact surfaces by the swivelling of the projecting part of the retaining element, as a result of which any contaminants are removed.

The projecting part can be provided with an arc-shaped, groove friction surface provided, for example with teeth, which surface can act together with a friction surface of the counterelement, between which friction surfaces the electrical conductor can be retained.

The projecting part can also be provided with a protrusion which in the retaining position extends transversely across the insertion position between the contacts and which protrusion, after it has been swivelled to this position, engages in a cavity in the counterelement, as a result of which the electrical conductor is retained by being bent around this protrusion. In this case, the foil can be secured by fixed protrusions which engage in openings in the foil.

A further protrusion which is at the same time displaced in an arc along with the projecting part and whose active surface faces a free end of one of the contacts, can lift this contact off the other contact as the projecting part swivels in the direction of the contacts past the counterelement, so that the electrical conductor can be pushed unhampered between the retaining elements and the opened contacts.

The spindle for the displacement of the projecting part of the retaining element is preferably coupled to a lever by means of which this spindle can be rotated for swiveling the projecting part in the direction of the contacts and consequently outside the position in which the projecting part is situated opposite the counterelement. When the counterelement is returned and a conductor is secured, the lever is finally arrested by a part of the casing so that the counterelement cannot swivel further and the conductor cannot be pulled out of its position between the contacts.

Connectors of the above type are preferably used in connector assemblies in which several connectors are accommodated next to each other in a common casing. The swivellable retaining elements are in this case coupled to a common spindle.

BRIEF DESCRIPTION OF THE DRAWINGS

The invention will now be explained in more detail on the basis of the drawings in which two exemplary embodiments are shown.

FIGS. 5 and 6 show in perspective a connector assembly constructed from several connectors according to FIGS. 1–4.

DESCRIPTION OF THE PREFERRED EMBODIMENTS

The connectors according to the invention shown in the figures are provided with a casing 1 of insulating material. Within the casing are contact elements 2 provided with two parallel contacts 3 and 4 having contact surfaces 5 and 6.

Figure 1:
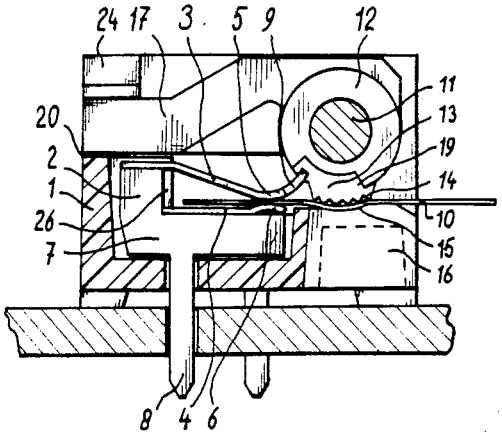
FIGS. 1 and 2 show a first embodiment of a connector according to the invention.
Figure 2:
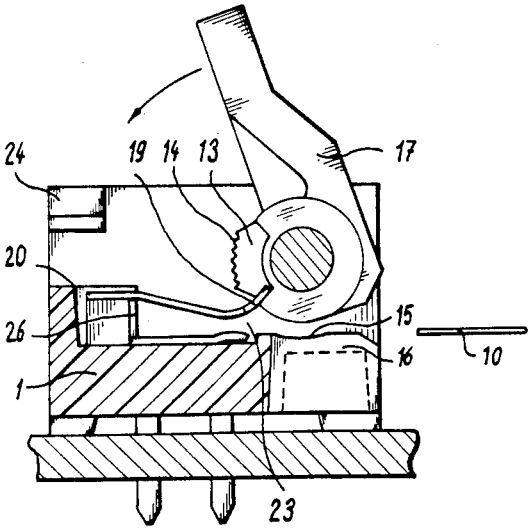

In the embodiment of FIGS. 1 and 2, the contacts 3 and 4 form part of contact element 2, which is obtained by punching and consists also of a flat part 7 with a connecting pin 8. The contacts 3 and 4 consist of parts of the flat part 7 bent through a right angle. The contact 3 has the form of a spring strip. The contact 4 remains permanently connected over the greatest part of its length to the flat part 7, with the exception of the contact surface 6 (See also FIG. 5). It should also be noted that the end of the contact 3 is provided with a projecting end 9, by means of which the contact 3 can be lifted from the contact 4 in order to be able to guide a conductor 10 between the contacts.

The connector further includes a spindle 11 around which a cylindrical part 12 is clamped or is integral with the spindle 11. In FIG. 1, the cylindrical part is provided on its lower side with a projecting part 13 having an arc-shaped, grooved friction surface provided, for example, with teeth 14. The projecting part 13 with its teeth 14 is opposite a friction surface 15 of a counterelement 16. As is evident from FIG. 1, the conductor 10 is clamped between the surfaces of the projecting part 13 and the counterelement 16. These surfaces must obviously approach each other sufficiently closely.

A lever 17 is also coupled to the spindle 11 and cylindrical part 12. By means of this lever 17, the spindle 11 can be rotated from the position in FIG. 1 to the position in FIG. 2 and vice versa. In the position in FIG. 2, the projecting part 13 is swivelled in the clockwise direction.

In addition to the projecting part 13, the cylindrical part 12 has a recess 18 having a protrusion surface or abutment 19. As is evident from FIG. 2, this protrusion surface 19 presses against the projecting free end 9 of contact 3 in the position shown in FIG. 2. As the level 17 swivels from the position in FIG. 1 to the position which is shown in FIG. 2, the surface 19 contacts the projecting end 9 and lifts the contact 3 off the contact 4. As a result, a gap 23 is created between the contact surfaces 5 and 6 through which a conductor 10 can easily be pushed between these contact surfaces 5 and 6 along the surface 15 of the counterelement 16.

The conductor 10 is inserted between the contacts 3 and 4, and is pushed up to the stop 26. The lever 17 can then be swivelled back down to the position shown in FIG. 1. As this is done, the toothed surface 14 at a given instant comes into contact with the conductor 10, which is then pushed to the right as the lever swivels further. In the meantime, the contact 3 is lowered back toward contact 4. When the protrusion surface 19 of the cylindrical part 12 no longer engages the projecting end 9 of the contact 3, the contact surface 5 will come to rest on the conductor 10, which is retained by the contact surface 6 situated on opposite side of the conductor. As the lever 17 is displaced still further downwards, the conductor 10 is carried along to the right by the toothed surface 14 and the bare parts of the conductor are pushed on either side along the contact surfaces 5 and 6, as a result of which any contaminants are removed. Finally, the lever 17 is arrested by the surface 20 of the casing 1. The projecting part 13 and its toothed surface 14 cannot therefore swivel further to the right, as a result of which the conductor 10 is firmly retained or clamped between the surfaces 14 and 15. With the aid of a clamping element 24 for the lever 17, the latter can be locked against being rotated back.

Figure 3:
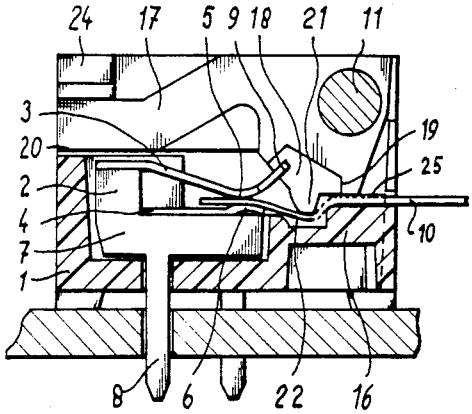
FIGS. 3 and 4 show a second embodiment of a connector according to the invention.
Figure 4:
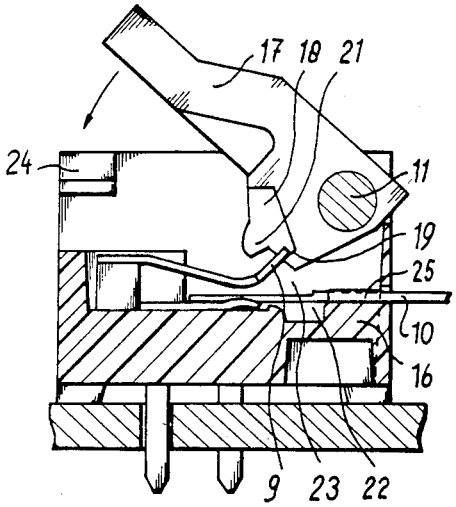

In the embodiment of FIGS. 3 and 4, the toothed surface 14 is replaced by a protrusion 21. In the position shown in FIG. 3, this protrusion 21 is located in a recess 22 in the counterelement 16.

The remaining components of this embodiment are indicated by the same reference figures as the embodiment of FIGS. 1 and 2.

FIG. 4 shows the position for the insertion of the conductor 10 between the contacts 3 and 4. The projecting end 9 of the contact 3 is raised up by the protrusion surface 19 so that there is a gap between the contact surfaces 5 and 6 for inserting the conductor 10. When the conductor 10 has to be secured, the lever 17 is again moved downwards. The protrusion 21 will then mate with the inserted part of the conductor 10 and bends the latter downwards into the recess 22. The lever 17 is finally arrested by the surface 20 of the casing 1 when the protrusion 21 is located in the recess 22, the conductor 10 being held in place by the severe bending. If a flat cable or flexible foil is used with conductors present in it, holes or openings can also be provided in this flexible foil or flat cable with which protrusions 25 mounted on the casing 1 of the connector can engage so that no displacement of the foil, which is situated outside the connector, can take place as a result of the bending by means of protrusion 21.

Figure 5:
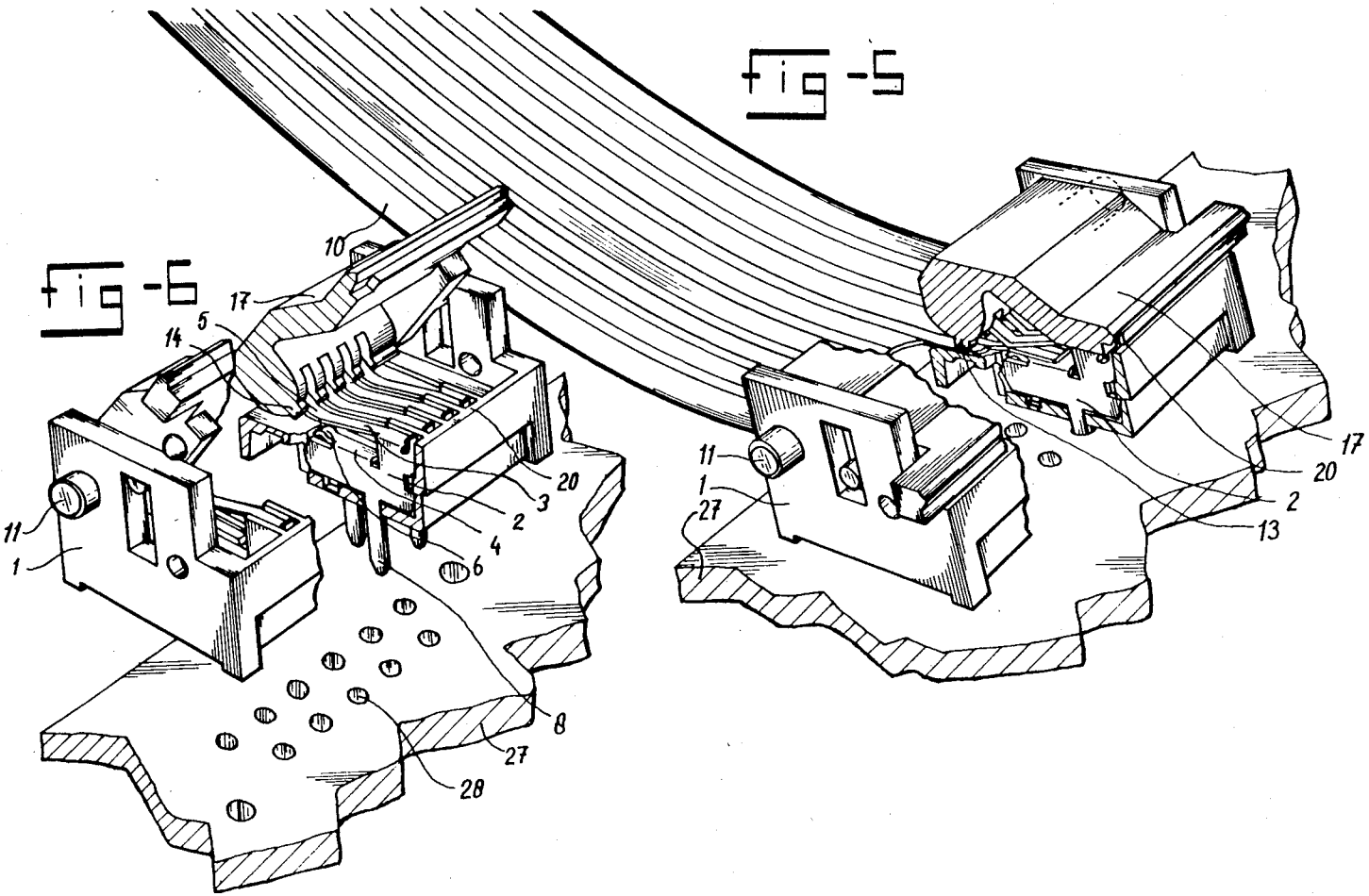

In place of the single connector shown in FIGS. 1–4, several such connectors can be combined into a connector assembly in a common casing using a common spindle and lever for all the individual connectors. Such a connector assembly is shown in FIGS. 5 and 6. The same reference figures as in FIGS. 1–4 indicate the same components, some reference figures having been omitted for the sake of clarity.

Obviously the common spindle or the part to which all the projecting parts 13 are fixed must possess adequate rigidity, especially if a wide flat cable or flexible foil is used, for the projecting parts of all the connectors to be adequately pressed against the counterelement over the whole length of the spindle of the connector assembly. In the open position according to FIGS. 2, 4 and 6, the spindle must also not bend towards the counterelement to such an extent that the insertion of the flat cable or foil is prevented.

In FIGS. 5 and 6 the common lever 17 also forms a cover for the various contact elements 2. This cover is provided with spindle pins 11 at the sides which project through openings in the side walls of the casing 1.

The connector assembly according to FIGS. 5 and 6 may be mounted on a board 27 having a printed wiring, while the connecting pines 8 are accommodated in suitable openings 28 in this board 27 and can be soldered into them.

The invention is not limited to the embodiments shown in the figures, but that alterations and additions are possible without going outside the scope of the invention.

I claim:

1. A connector for one or more conductors comprising:

means for electrically contacting each conductor disposed within a casing of insulating material, said contact means including two parallel extending contacts with contact surfaces spring based against each other, and means for retaining said conductor in a position between the contacts, said retaining means including a swivel means adapted to be rotated about one point, said swivel means having a projecting part which cooperates with a stationary counterelement to retain the conductor, said swivel means also having an abutment surface adapted to engage an end of one of the parallel extending contacts, whereby rotating the swivel means in one direction will move the projecting part away from a position adjoining the counterelement and will cause the abutment surface to engage the end of said one contact so as to lift the contact to create a gap between said contact surfaces through which the conductor may be inserted, and whereby subsequently rotating the swivel means in the other direction will lower said one contact until its end is free of the abutment surface and the projecting part is positioned adjacent the counterelement, said conductor thereby being electrically contacted by said spring biased contact surfaces and also being retained by the clamping action between the projecting part and the counterelement.

2. The connector of claim 1, wherein the swivel means is a cylindrical element and the projecting part is a projecting, arc-shaped portion of the annular surface of the cylindrical element, said arc-shaped portion having teeth to form a friction surface which cooperates with a surface of the counterelement to retain the conductor.

3. The connector of claim 1, wherein the projecting part is provided a protrusion and the counterelement is provided with a cavity so that when the swivel means is rotated in the other direction, the protrusion will engage the conductor and bend it downward into the cavity.

4. The connector of claim 1, further comprising a lever for rotating the swivel means and means for stopping the lever when the swivel means is rotated to position where the projecting part and stationary counterelement are adjacent one another to retain said conductor.

5. A connector according to claim 1 wherein a plurality of parallel conductors within a flat cable or flexible foil are to be contacted, the connector including within the casing of insulating material a plurality of said electrical contacting means and said retaining means for each parallel conductor, said swivel means adapted to rotate each said projecting part simultaneously about the same point by means of a common lever to simultaneously contain and retain all the conductors.

6. The connector of claim 5, further including protrusions extending from the casing for engaging openings located between the parallel conductors in the flat cables or flexible foil when the swivel means is rotated in the other direction to retain said conductors.

* * * * *